US007128044B1

(12) United States Patent
Doering et al.

(10) Patent No.: US 7,128,044 B1
(45) Date of Patent: Oct. 31, 2006

(54) ENGINE CONTROL WITH VARIABLE CONTROL VALVE

(75) Inventors: Jeff Doering, Canton, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/130,579

(22) Filed: May 16, 2005

(51) Int. Cl.
*F02D 17/00* (2006.01)

(52) U.S. Cl. ..... 123/198 F; 123/539

(58) Field of Classification Search ..... 123/198 F, 123/539, 590

See application file for complete search history.

(56) References Cited

U.S. PATENT DOCUMENTS 4,296,719 A * 10/1981 Takahashi et al. ..... 123/198 F
4,366,788 A 1/1983 Tanaka et al.
4,550,704 A 11/1985 Barho et al.
4,556,026 A 12/1985 Masuda et al.
5,099,816 A * 3/1992 Ohga et al. ..... 123/481
5,398,544 A * 3/1995 Lipinski et al. ..... 73/118.2
6,435,156 B1 * 8/2002 Copus ..... 123/198 F

* cited by examiner

*Primary Examiner*—Stephen K. Cronin
*Assistant Examiner*—Jason Benton
(74) *Attorney, Agent, or Firm*—Allan J. Líppa; Alleman Hall McCoy Russell & Tuttle LLP

(57) ABSTRACT

A method of operating an internal combustion engine. The method includes disabling at least one piston cylinder of the engine. While said at least one piston cylinder is disabled, turbulence is selectively varied in an air intake pathway of an enabled piston cylinder, so as to vary charge motion within the enabled piston cylinder. The selective variation of turbulence is effected at a location in the air intake pathway between a throttle of the engine and an intake valve of the enabled cylinder.

25 Claims, 6 Drawing Sheets

ENGINE CONTROL WITH VARIABLE CONTROL VALVE

BACKGROUND AND SUMMARY

By disabling some of the cylinders on an engine when the desired torque is relatively low (e.g., at idle or other situations), an engine can be operated at a higher manifold pressure to supply needed airflow to the operating cylinders. For example, the engine may be operated with a wider throttle while cylinders are disabled. This can reduce engine pumping losses and make the engine more efficient.

However, when an engine is run on less than all of its cylinders, the frequency of torque pulsations and the magnitude of those pulsations may be increased relative to operating the engine with all cylinders enabled. The low frequency and high magnitude torque pulsations can result in transmission of more vibration to vehicle occupants. Vehicle occupants may thus be more likely to perceive an undesirable amount of noise, vibration, harshness (NVH) during operating modes when cylinders are disabled.

In one approach, the above issue may be addressed by a method of operating an internal combustion engine, comprising:

disabling a first piston cylinder of the engine;

positioning a turbulence member in a first position while the first piston cylinder is disabled, the turbulence member being movably disposed in an air intake pathway between a throttle of the engine and an intake valve of an enabled piston cylinder; and positioning the turbulence member in a second position while the first piston cylinder is disabled, where moving the turbulence member from the first position to the second position causes turbulence to vary in the air intake pathway.

In this way, it is possible to adjust combustion characteristics to at least partially compensate for potentially increased noise and/or vibration during partial cylinder operation, such as during lower torque and/or lower speed conditions.

DETAILED DESCRIPTION OF THE DRAWINGS

DETAILED DESCRIPTION

Figure 1:
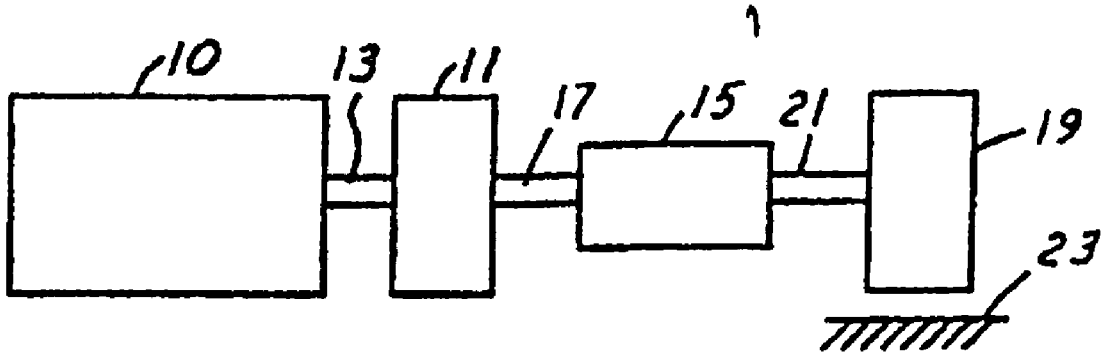
FIG. 1 is a block diagram of a vehicle illustrating various components of the powertrain system.
Figure 1A:
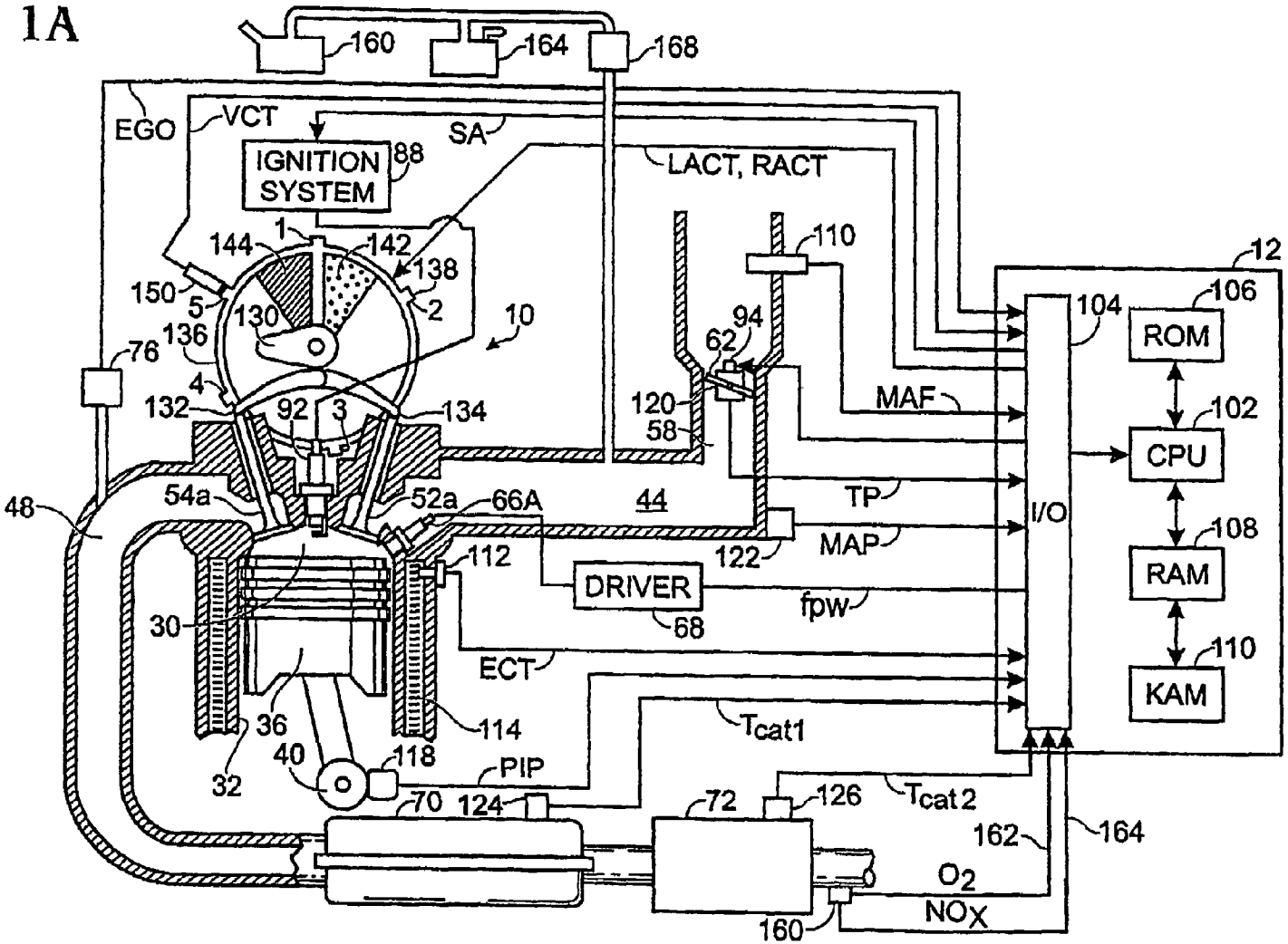
FIGS. 1A and 1B show a partial engine view.
Figure 1B:
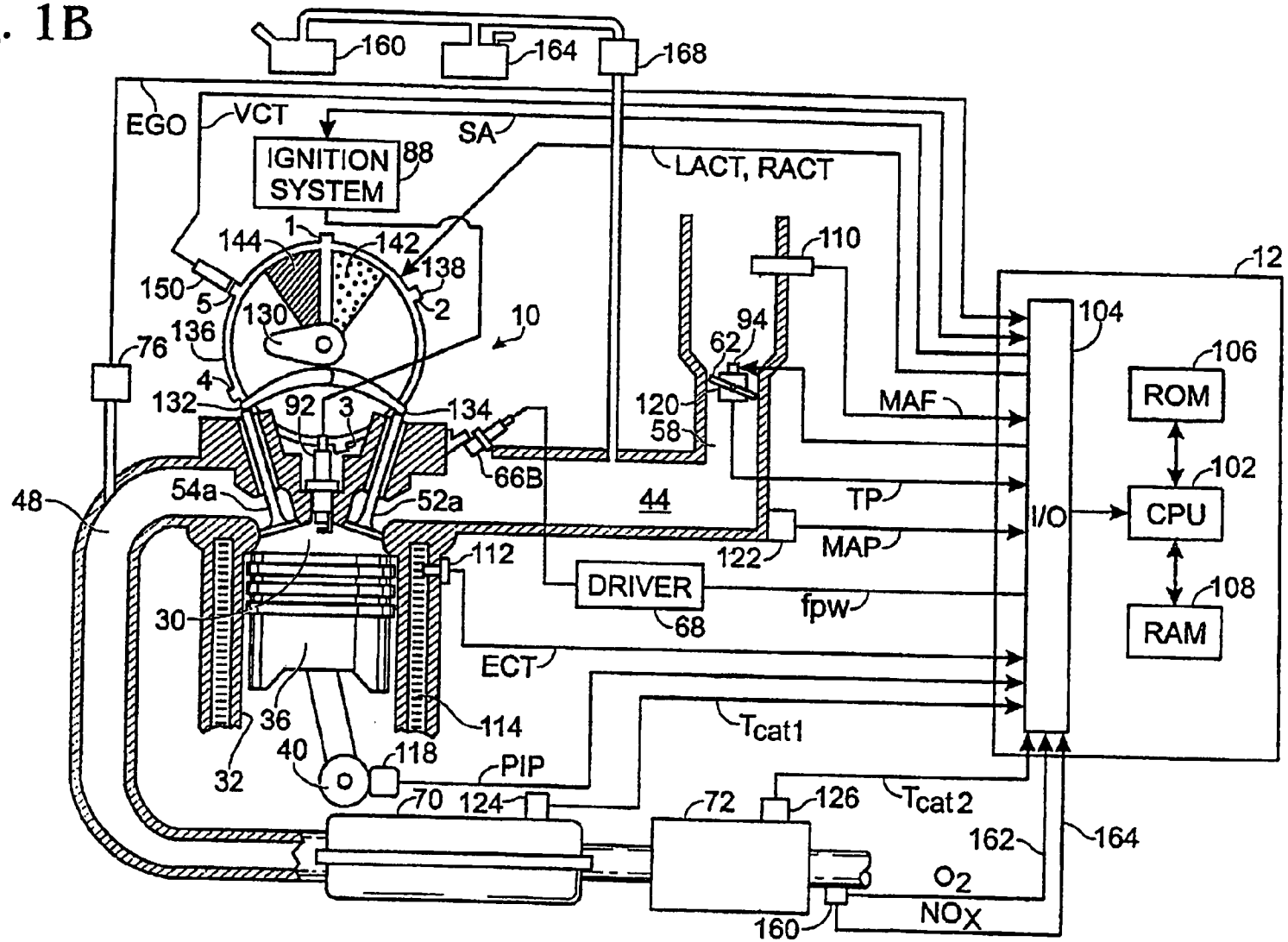

Referring to FIG. 1, internal combustion engine 10, further described herein with particular reference to FIGS. 1A and 1B, is shown coupled to torque converter 11 via crankshaft 13. Torque converter 11 is also coupled to transmission 15 via turbine shaft 17. Torque converter 11 has a bypass, or lock-up clutch 14 which can be engaged, disengaged, or partially engaged. When the clutch is either disengaged or partially engaged, the torque converter is said to be in an unlocked state. The lock-up clutch 14 can be actuated electrically, hydraulically, or electro-hydraulically, for example. The lock-up clutch 14 receives a control signal (not shown) from the controller, described in more detail below. The control signal may be a pulse width modulated signal to engage, partially engage, and disengage, the clutch based on engine, vehicle, and/or transmission operating conditions. Turbine shaft 17 is also known as transmission input shaft. Transmission 15 comprises an electronically controlled transmission with a plurality of selectable discrete gear ratios. Transmission 15 also comprises various other gears, such as, for example, a final drive ratio (not shown). Transmission 15 is also coupled to tire 19 via axle 21. Tire 19 interfaces the vehicle (not shown) to the road 23. Note that in one example embodiment, this powertrain is coupled in a passenger vehicle that travels on the road.

FIGS. 1A and 1B show one cylinder of a multi-cylinder engine, as well as the intake and exhaust path connected to that cylinder. Continuing with FIG. 1A, direct injection spark ignited internal combustion engine 10, comprising a plurality of combustion chambers, is controlled by electronic engine controller 12. Combustion chamber 30 of engine 10 is shown including combustion chamber walls 32 with piston 36 positioned therein and connected to crankshaft 40. A starter motor (not shown) is coupled to crankshaft 40 via a flywheel (not shown). In this particular example, piston 36 includes a recess or bowl (not shown) to help in forming stratified charges of air and fuel. Combustion chamber, or cylinder, 30 is shown communicating with intake manifold 44 and exhaust manifold 48 via respective intake valves 52*a* and 52*b* (not shown), and exhaust valves 54*a* and 54*b* (not shown). Fuel injector 66A is shown directly coupled to combustion chamber 30 for delivering injected fuel directly therein in proportion to the pulse width of signal fpw received from controller 12 via conventional electronic driver 68. Fuel is delivered to fuel injector 66A by a conventional high pressure fuel system (not shown) including a fuel tank, fuel pumps, and a fuel rail.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC), which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas sensor 76 is shown coupled to exhaust manifold 48 upstream of catalytic converter 70 (note that sensor 76 corresponds to various different sensors, depending on the exhaust configuration as described below with regard to FIG. 2. Sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12.

Controller 12 causes combustion chamber 30 to operate in either a homogeneous air/fuel mode or a stratified air/fuel mode by controlling injection timing. In the stratified mode, controller 12 activates fuel injector 66A during the engine compression stroke so that fuel is sprayed directly into the bowl of piston 36. Stratified air/fuel layers are thereby formed. The strata closest to the spark plug contain a stoichiometric mixture or a mixture slightly rich of stoichiometry, and subsequent strata contain progressively leaner mixtures. During the homogeneous mode, controller 12 activates fuel injector 66A during the intake stroke so that a substantially homogeneous air/fuel mixture is formed when ignition power is supplied to spark plug 92 by ignition system 88. Controller 12 controls the amount of fuel delivered by fuel injector 66A so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel ratio being a function of the amount of fuel delivered to combustion chamber 30. An additional split mode of operation wherein additional fuel is injected during the exhaust stroke while operating in the stratified mode is also possible.

Nitrogen oxide (NOx) adsorbent or trap 72 is shown positioned downstream of catalytic converter 70. NOx trap 72 is a three-way catalyst that adsorbs NOx when engine 10 is operating lean of stoichiometry. The adsorbed NOx is subsequently reacted with HC and CO and catalyzed when controller 12 causes engine 10 to operate in either a rich homogeneous mode or a near stoichiometric homogeneous mode such operation occurs during a NOx purge cycle when it is desired to purge stored NOx from NOx trap 72, or during a vapor purge cycle to recover fuel vapors from fuel tank 160 and fuel vapor storage canister 164 via purge control valve 168, or during operating modes requiring more engine power, or during operation modes regulating temperature of the omission control devices such as catalyst 70 or NOx trap 72. It will be understood that various different types and configurations of emission control devices and purging systems may be employed.

Controller 12 is shown in FIG. 1A as a conventional microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120; and absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give and indication of engine load. Further, this sensor, along with engine speed, can provide an estimate of charge (including air) inducted into the cylinder. In a one example, sensor 118, which is also used as an engine speed sensor, produces a predetermined number of equally spaced pulses every revolution of the crankshaft.

In this particular example, temperature Tcat1 of catalytic converter 70 and temperature Tcat2 of emission control device 72 (which can be a NOx trap) are inferred from engine operation as disclosed in U.S. Pat. No. 5,414,994, the specification of which is incorporated herein by reference. In an alternate embodiment, temperature Tcat1 is provided by temperature sensor 124 and temperature Tcat2 is provided by temperature sensor 126.

Continuing with FIG. 1A, camshaft 130 of engine 10 is shown communicating with rocker arms 132 and 134 for actuating intake valves 52*a*, 52*b* and exhaust valve 54*a*. 54*b*. Camshaft 130 is directly coupled to housing 136. Housing 136 forms a toothed wheel having a plurality of teeth 138. Housing 136 is hydraulically coupled to an inner shaft (not shown), which is in turn directly linked to camshaft 130 via a timing chain (not shown). Therefore, housing 136 and camshaft 130 rotate at a speed substantially equivalent to the inner camshaft. The inner camshaft rotates at a constant speed ratio to crankshaft 40. However, by manipulation of the hydraulic coupling as will be described later herein, the relative position of camshaft 130 to crankshaft 40 can be varied by hydraulic pressures in advance chamber 142 and retard chamber 144. By allowing high pressure hydraulic fluid to enter advance chamber 142, the relative relationship between camshaft 130 and crankshaft 40 is advanced. Thus, intake valves 52*a*, 52*b* and exhaust valves 54*a*, 54*b* open and close at a time earlier than normal relative to crankshaft 40. Similarly, by allowing high pressure hydraulic fluid to enter retard chamber 144, the relative relationship between camshaft 130 and crankshaft 40 is retarded. Thus, intake valves 52*a*, 52*b*, and exhaust valves 54*a*, 54*b* open and close at a time later than normal relative to crankshaft 40.

Teeth 138, being coupled to housing 136 and camshaft 130, allow for measurement of relative cam position via cam timing sensor 150 providing signal VCT to controller 12. Teeth 1, 2, 3, and 4 are preferably used for measurement of cam timing and are equally spaced (for example, in a V-8 dual bank engine, spaced 90 degrees apart from one another) while tooth 5 is preferably used for cylinder identification, as described later herein. In addition, controller 12 sends control signals (LACT, RACT) to conventional solenoid valves (not shown) to control the flow of hydraulic fluid either into advance chamber 142, retard chamber 144, or neither.

Relative cam timing is measured using the method described in U.S. Pat. No. 5,548,995, which is incorporated herein by reference. In general terms, the time, or rotation angle between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

Sensor 160 provides an indication of both oxygen concentration in the exhaust gas as well as NOx concentration. Signal 162 provides controller a voltage indicative of the $O_2$ concentration while signal 164 provides a voltage indicative of NOx concentration. Alternatively, sensor 160 can be a HEGO, UEGO, EGO, or other type of exhaust gas sensor. Also note that, as described above with regard to sensor 76, sensor 160 can correspond to various different sensors depending on the system configuration.

As described above, FIGS. 1A (and 1B) merely show one cylinder of a multi-cylinder engine, and that each cylinder has its own set of intake/exhaust valves, fuel injectors, spark plugs, etc.

Referring now to FIG. 1B, a port fuel injection configuration is shown where fuel injector 66B is coupled to intake manifold 44, rather than directly cylinder 30.

It will be appreciated that the examples of FIGS. 1A and 1B are but two examples, and that many other engine configurations are possible. For example, instead of the cam mechanisms discussed above, intake and exhaust valves (e.g., intake valves 52*a*, 52*b* and exhaust valves 54*a*, 54*b*) may be actuated electromechanically or electrohydraulically.

Also, in the example embodiments described herein, the engine is coupled to a starter motor (not shown) for starting the engine. The starter motor is powered when the driver turns a key in the ignition switch on the steering column, for example. The starter is disengaged after engine start as evidence, for example, by engine 10 reaching a predetermined speed after a predetermined time. Further, in the disclosed embodiments, an exhaust gas recirculation (EGR) system routes a desired portion of exhaust gas from exhaust manifold 48 to intake manifold 44 via an EGR valve (not shown). Alternatively, a portion of combustion gases may be retained in the combustion chambers by controlling exhaust valve timing.

The engine 10 operates in various modes, including lean operation, rich operation, and "near stoichiometric" operation. "Near stoichiometric" operation refers to oscillatory operation around the stoichiometric air fuel ratio. Typically, this oscillatory operation is governed by feedback from exhaust gas oxygen sensors. In this near stoichiometric operating mode, the engine is operated within approximately one air-fuel ratio of the stoichiometric air-fuel ratio. This oscillatory operation is typically on the order of 1 Hz, but can vary faster and slower than 1 Hz. Further, the amplitude of the oscillations are typically within 1 a/f ratio of stoichiometry, but can be greater than 1 a/f ratio under various operating conditions. Note that this oscillation does not have to be symmetrical in amplitude or time. Further note that an air-fuel bias can be included, where the bias is adjusted slightly lean, or rich, of stoichiometry (e.g., within 1 a/f ratio of stoichiometry). Also note that this bias and the lean and rich oscillations can be governed by an estimate of the amount of oxygen stored in upstream and/or downstream three way catalysts.

As described below, feedback air-fuel ratio control is used for providing the near stoichiometric operation. Further, feedback from exhaust gas oxygen sensors can be used for controlling air-fuel ratio during lean and during rich operation. In particular, a switching type, heated exhaust gas oxygen sensor (HEGO) can be used for stoichiometric air-fuel ratio control by controlling fuel injected (or additional air via throttle or VCT) based on feedback from the HEGO sensor and the desired air-fuel ratio. Further, a UEGO sensor (which provides a substantially linear output versus exhaust air-fuel ratio) can be used for controlling air-fuel ratio during lean, rich, and stoichiometric operation. In this case, fuel injection (or additional air via throttle or VCT) is adjusted based on a desired air-fuel ratio and the air-fuel ratio from the sensor. Further still, individual cylinder air-fuel ratio control could be used, if desired.

Also note that various methods can be used to maintain the desired torque such as, for example, adjusting ignition timing, throttle position, variable cam timing position, exhaust gas recirculation amount, and a number of cylinders carrying out combustion. Further, these variables can be individually adjusted for each cylinder to maintain cylinder balance among all the cylinder groups.

It will at times be desirable to operate the engine with one or more cylinders disabled. Typically, cylinders are disabled under low load conditions, such as at idle, while maintaining cruising speed (e.g., highway driving), etc. As shown in the torque-speed plot of FIG. 2, all of the cylinders are enabled at certain times to achieve the desired engine output. Specifically, in the region between curve 190 and curve 192, all cylinders are enabled. Underneath curve 192 (e.g., lower load conditions), one or more cylinders are disabled (e.g., all intake and exhaust valves are held closed). Additionally, as explained in detail below with reference to curves 194 and 196, intake turbulence control may be coordinated with cylinder disablement to reduce noise, vibration and/or harshness that may result from disabling cylinders.

Figure 2:
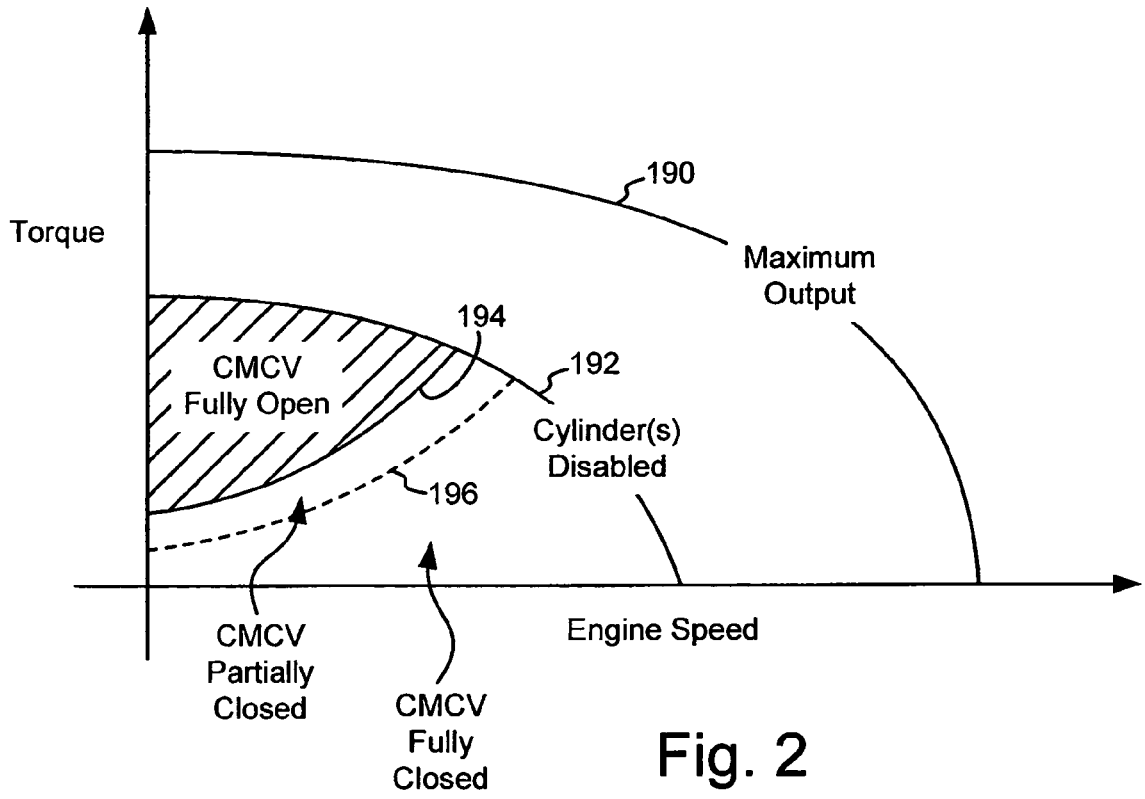
FIG. 2 is a graph showing different engine operating modes at different speed torque regions.

Continuing with FIG. 2, cylinders may be deactivated underneath curve 192 because only a fraction of the engine's peak horsepower is needed during a low load condition. Using a reduced number of more heavily loaded cylinders can provide improved engine efficiency and fuel economy.

The improved efficiency results from a reduction in pumping losses that occurs when one or more cylinders are disabled. When cylinders are disabled, cylinder intake and exhaust valves typically are disabled, allowing the engine to be operated at a higher manifold pressure (e.g., with a wider throttle) to supply the needed airflow to the operating cylinders. The higher pressure reduces the pumping load on the operating cylinders. Also, instead of working against the vacuum in the intake manifold, the disabled cylinders are aided while returning to bottom dead center by the "air spring" effect resulting from sealing off the cylinder. Typically, spark and fuel delivery is also interrupted when cylinders are disabled.

In cam-based engines, various methods may be employed to disable cylinder intake and/or exhaust valves. Transfer of motion from a cam lobe to a valve stem may be interrupted by using controlled squirt of oil to slide a disabling pin inside selected valve lifters or rocker arms. In pushrod applications, the outer portion of each disabled lifter telescopes over the inner portion to maintain contact with the cam lobe without opening the valve. Similar to cam lobe or profile switching schemes, the disabling pin may be used to select a rocker arm alignment that provides no valve lift. In EVA systems, valve operation may simply be interrupted via the control signals applied to the valve actuators.

Figure 3:
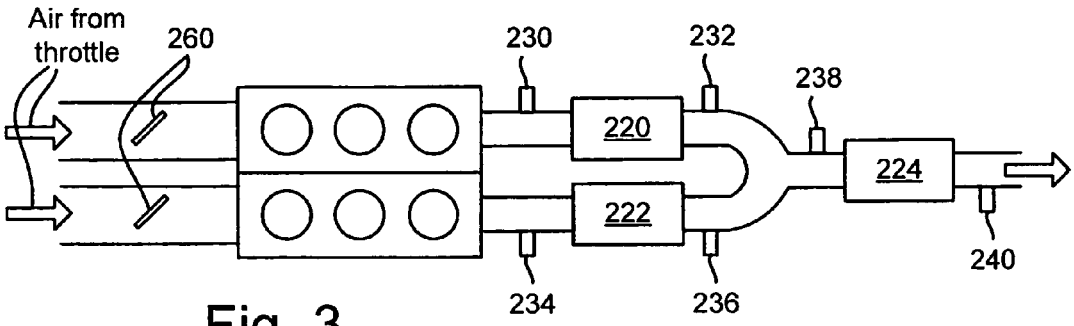
FIGS. 3–6 show various schematic system configurations.
Figure 4:
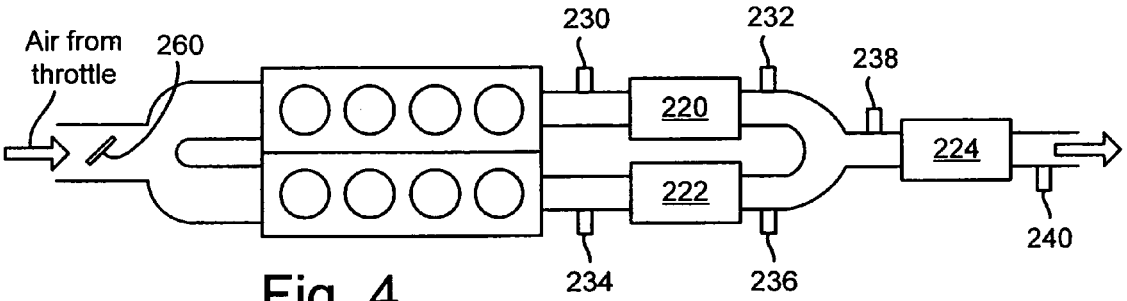
Figure 5:
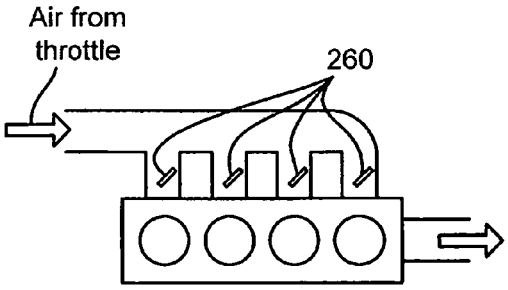

Referring now to FIGS. 3–5, various exemplary engine configurations are shown in which cylinders may be disabled. Referring first to FIGS. 3–4, example configurations using a V-6 engine and a V-8 engine are shown, though these are merely two examples, since a V-10, V-12, 14, 16, etc., could also be used. Note that while numerous exhaust gas oxygen sensors are shown, a subset of these sensors can also be used. Further, only a subset of the emission control devices can be used, and a non-y-pipe after-treatment configuration can also be used.

In V configurations such as that shown in FIGS. 3–4, cylinders may be divided into two banks, corresponding to the two sides of the engine block. In both V and non-V configurations, cylinders may also be divided into combustion chamber groups, corresponding to firing order used to achieve torque balancing, or corresponding to common intake or exhaust air pathways. In V configurations, a given combustion chamber group may include cylinders from both banks, or from just one of the banks.

Continuing with FIGS. 3–4, some cylinders may be coupled to first catalytic converter 220, with the remainder being coupled to catalyst 222. Upstream of catalyst 220 is an exhaust gas oxygen sensor 230. Downstream of catalyst 220 is a second exhaust gas sensor 232. Upstream and downstream of catalyst 222 are exhaust gas oxygen sensors 234 and 236, respectively. Exhaust gas spilled from the first and second catalyst 220 and 222 merge in a Y-pipe configuration before entering downstream under body catalyst 224. Also, exhaust gas oxygen sensors 238 and 240 are positioned upstream and downstream of catalyst 224, respectively.

In one example embodiment, catalysts 220 and 222 are platinum and rhodium catalysts that retain oxidants when operating lean and release and reduce the retained oxidants when operating rich. Further, these catalysts can have multiple bricks, and further these catalysts can represent several separate emission control devices.

Similarly, downstream underbody catalyst 224 also operates to retain oxidants when operating lean and release and reduce retained oxidants when operating rich. As described above, downstream catalyst 224 can be a group of bricks, or several emission control devices. Downstream catalyst 224 is typically a catalyst including a precious metal and alkaline earth and alkaline metal and base metal oxide. In this particular example, downstream catalyst 224 contains platinum and barium.

Note that various other emission control devices could be used, such as catalysts containing palladium or perovskites. Also, exhaust gas oxygen sensors 230 to 240 can be sensors of various types. For example, they can be linear oxygen sensors for providing an indication of air-fuel ratio across a broad range. Also, they can be switching type exhaust gas oxygen sensors that provide a switch in sensor output at the stoichiometric point. Also, the system can provide less than all of sensors 230 to 240, for example, only sensors 230, 234, and 240. In another example, only sensor 230, 234 are used with only devices 220 and 222.

Figure 6:
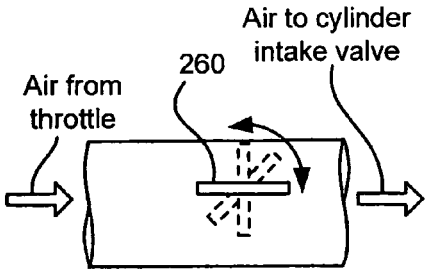

Referring now to FIG. 6, a turbulence member is depicted. In the depicted example, the turbulence member is implemented as a charge motion control valve (CMCV) 260 positioned between the throttle (e.g., throttle plate 62) and a cylinder intake valve. In other words, the CMCV is positioned in the air intake pathway so as to be downstream of the throttle and upstream of the cylinder intake valve.

As shown, CMCV 260 is movable and positionable anywhere between a fully open position (shown in solid lines) and a fully closed position C, inclusive. The exact desired position may be determined based on a variety of parameters, including engine speed, engine load, engine air-fuel ration, required combustion stability, etc. Typically, the position is controlled by a motor or other actuator, based on control signals provided from the engine control computer (e.g., electronic engine controller 12).

In the fully closed position C, CMCV 260 creates a higher level of turbulence, such as swirl and tumble, in the air intake pathway. This results in increased charge motion within the cylinder, which in turn increases the burn rate and peak pressures within the cylinder. This produces higher torque amplitude in the cylinder, which will be desirable in some circumstances, though a closed CMCV position typically reduces volumetric efficiency of the engine. Thus at times it will be desirable to partially or completely open the CMCV, based on various factors, leading to increased volumetric efficiency and a relatively lower degree of turbulence and cylinder charge motion.

CMCV 260 typically is coupled to an actuating motor via a linkage, with the motor being controlled in response to control signals from the engine control computer. A position sensor or sensors may be coupled to the motor and/or to CMCV 260 to facilitate closed-loop position control over the CMCV.

FIGS. 3–5 show use of CMCVs 260 in various exemplary engine configurations. In FIG. 3, two CMCVs 260 are shown, each being associated with multiple cylinders. In particular, one CMCV is provided for each of the two banks of cylinders. Though the depicted example is a V-6 engine, an arrangement in which a CMCV is shared by multiple cylinders may be employed on a V-12, V-10, V-8, 14, 16, etc. In FIG. 4, one CMCV is shared among all of a V-8 engine's cylinders. In FIG. 5, a CMCV is provided for each cylinder in an 14 engine configuration. As with FIG. 3, the CMCV arrangements of FIGS. 4–5 may be employed on a variety of different engine configurations.

Although CMCVs are used in the depicted examples, other methods and/or devices may be employed to vary flow dynamics in the cylinder intake pathway(s). Other examples include swirl control valves (SCV), intake manifold runner control valves (IMRC), etc.

As described with reference to FIG. 2, it may in some cases be desirable to run an engine with one or more cylinders disabled. For example, the configurations of FIGS. 3 and 4 may be selectively run in a mode in which only half of the cylinders are enabled (e.g., by disabling one bank of cylinders). The disabled cylinder mode (corresponding to the area under curve 192) does not require a specific number of cylinders (e.g., half) to be disabled. It only requires disablement of at least one of the engine's cylinders.

When an engine is run on less than all of its cylinders, relative to operating all the cylinders, the frequency of torque pulsations produced by the engine typically is reduced and the torque magnitude for the operating (enabled) cylinders is increased. The lower frequency, higher amplitude torque pulsations tend to result in more transmission of the vibrations to the passengers. This can result in passengers perceiving an undesirable level of noise, vibrations and/or harshness (NVH).

Figure 7:
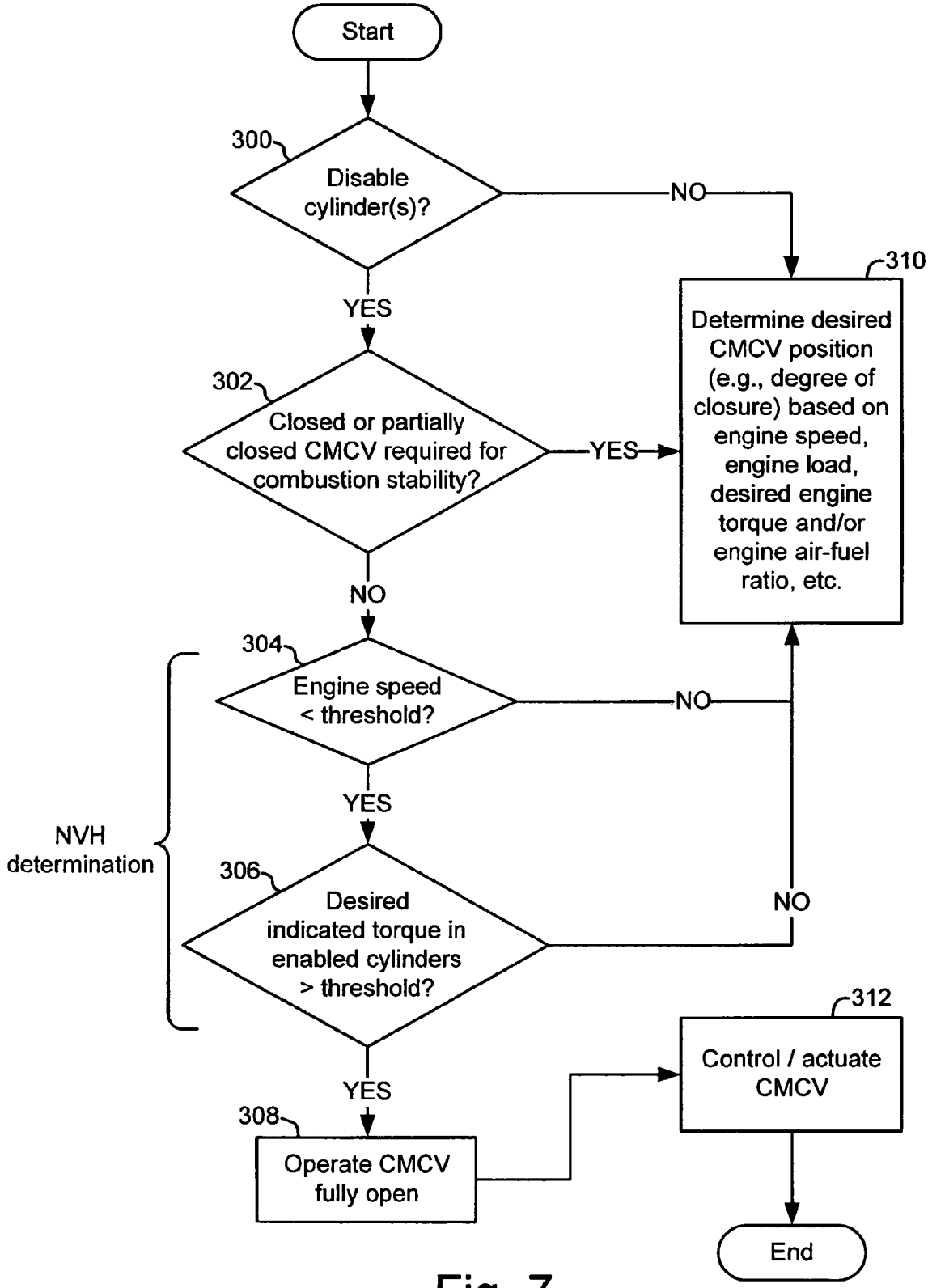
FIG. 7 is a flowchart depicting an exemplary method for selectively varying intake air turbulence while one or more piston cylinders are disabled.

Accordingly, as will now be described with reference to FIGS. 7 and 2, turbulence control may be employed during cylinder disablement modes to mitigate NVH and provide other advantages. Referring first to the exemplary method implementation of FIG. 7, at 300 the method includes determining whether the engine should be operated in a mode with one or more cylinders disabled. As discussed previously, disabled cylinder modes are typically employed during relatively low load operating conditions. With cylinder disablement (e.g., operating under curve 192 in FIG. 2), intake and/or exhaust valves typically are controlled so as to remain closed while the cylinder is disabled. Spark and fuel delivery typically are also interrupted while the cylinder is disabled.

At 302, the method may include assessing combustion stability requirements for the operational (i.e., enabled) cylinder or cylinders. In particular, a relatively higher degree of turbulence (e.g., swirl and/or tumble) may be needed or desired in the intake pathway to increase cylinder charge motion and thereby improve combustion stability in the operating cylinder. To achieve this non-minimal turbulence, the desired CMCV position may be partially or completely closed.

If combustion stability requirements for the operating cylinder(s) are satisfied, the method may further include assessment of an NVH condition. In particular, various factors may be considered to assess whether the cylinder disablement operation is likely to lead to an increased perception by vehicle occupants of noise, vibration, and/or harshness. For example, at 304, the exemplary method includes determining whether engine speed is below a threshold, while at 306, it is determined whether the desired or indicated torque in the operating cylinder(s) exceeds a threshold. If engine speed is less than the speed threshold and torque exceeds the torque threshold, than the desired CMCV position is determined to be fully open, as shown at 308.

The fully open CMCV position corresponds to the region bounded by curves 194 and 192 in FIG. 2. As can be seen from curve 194, the torque threshold that triggers full opening of the CMCV may vary with engine speed, and vice versa.

If cylinders are not disabled (step 300), or if combustion stability requires a closed or partially closed CMCV (step 302), or if an NVH condition is not detected (steps 304, 306), the method may include determining desired CMCV position based on various factors, as shown at 310. Typically, these factors include operating conditions obtainable by the engine control computer (e.g., controller) via various sensors. The factors may include, engine speed, engine load, desired torque, engine air-fuel ratio, etc. Any position between the fully open and fully closed position may be selected, with turbulence increasing as the CMCV is moved toward the fully closed position.

When the engine is operated with all cylinders enabled (e.g., "No" at step 300), the determination at 310 may yield a CMCV position corresponding to minimal turbulence (e.g., fully open CMCV).

During disablement of one or more cylinders, the turbulence in the air intake pathway for a given operating cylinder may be selectively controlled via the described exemplary method and embodiments. Maximal turbulence may be provided, minimal turbulence, or anywhere in between. Specifically, during cylinder disablement, a given CMCV may be fully open (region in FIG. 2 bounded by curves 194 and 192), as determined at 302, 304, 306, and 308 in FIG. 7; partially closed (area bounded by curves 192, 194 and 196), as determined at 310; or completely closed (area bounded by curves 192 and 196), as determined at 310.

In any case, the method includes, at 312, controlling/actuating the CMCV to move it into the desired position.

By selectively controlling turbulence during cylinder disablement, the disclosed embodiments and method implementations can reduce undesirable NVH while retaining the advantages obtained by operating the engine with cylinders disabled.

In addition to the above, it will further be appreciated that a CMCV valve's position may be determined based on whether or not the engine is being operated in a mode with one or more cylinders disabled.

It will be appreciated that the embodiments and method implementations disclosed herein are exemplary in nature, and that these specific examples are not to be considered in a limiting sense, because numerous variations are possible. The subject matter of the present disclosure includes all novel and nonobvious combinations and subcombinations of the various intake configurations and method implementations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A method of operating A multiple cylinder internal combustion engine, comprising:

disabling a first piston cylinder of the engine;

positioning a turbulence member in a first position while the first piston cylinder is disabled, the turbulence member being movably disposed in an air intake pathway between a throttle of the engine and an intake valve of an enabled piston cylinder; and positioning the turbulence member in a second position while the first piston cylinder is disabled, where moving the turbulence member from the first position to the second position causes turbulence to vary in the air intake pathway.

2. The method of claim 1, where the turbulence member is a charge motion control valve.

3. The method of claim 2, where positioning the charge motion control valve in the second position reduces turbulence in the air intake pathway, relative to the first position of the charge motion control valve.

4. The method of claim 1, where positioning the turbulence member in the second position reduces turbulence in the air intake pathway, relative to the first position of the turbulence member.

5. The method of claim 4, where positioning the turbulence member in the second position is performed upon detection of a noise, vibration, harshness (NVH) condition.

6. The method of claim 4, where positioning the turbulence member in the second position is performed in response to engine speed being below an engine speed threshold.

7. The method of claim 4, where positioning the turbulence member in the second position is performed in response to indicated torque for the enabled piston cylinder being above a torque threshold.

8. The method of claim 4, where positioning the turbulence member in the second position is performed in response to engine speed being below an engine speed threshold, and indicated torque for the enabled piston cylinder being above a torque threshold.

9. The method of claim 4, where the second position corresponds to a fully open position of the turbulence member, the turbulence member being movable and positionable anywhere between the fully open position and a fully closed position, and where the turbulence member is configured so that moving the turbulence member toward the fully closed position from the fully open position produces increasing turbulence in the air intake pathway.

10. An internal combustion engine, comprising:

a first piston cylinder;

a second piston cylinder, where the engine is configured to operate either with both piston cylinders enabled, or with the first piston cylinder enabled and the second piston cylinder disabled;

an air intake pathway defined between a throttle of the engine and an intake valve of the first piston cylinder; and a turbulence member positioned in the air intake pathway, the engine being configured to move the turbulence member from a first position to a second position while the second piston cylinder is disabled.

11. The engine of claim 10, where the turbulence member is a charge motion control valve.

12. The engine of claim 10, where moving the turbulence member from the first position to the second position varies turbulence produced in air flowing within the air intake pathway, thereby varying charge motion occurring within the first piston cylinder during intake and compression cycles of the first piston cylinder.

13. The engine of claim 12, where the turbulence member is configured to produce less turbulence within the air intake pathway when in the second position than when in the first position.

14. The engine of claim 13, where the engine is configured to cause the turbulence member to move into the second position while the second piston cylinder is disabled upon detection of a noise, vibration, harshness (NVH) condition.

15. The engine of claim 13, where the engine is configured to cause the turbulence member to move into the second position while the second piston cylinder is disabled in response to engine speed being below an engine speed threshold.

16. The engine of claim 13, where the engine is configured to cause the turbulence member to move into the second position while the second piston cylinder is disabled in response to indicated torque for the first piston cylinder being above a torque threshold.

17. The engine of claim 13, where the engine is configured to cause the turbulence member to move into the second position while the second piston cylinder is disabled in response to engine speed being below an engine speed threshold, and indicated torque for the first piston cylinder being above a torque threshold.

18. A method of operating an internal combustion engine, comprising:

disabling at least one piston cylinder of the engine; and while said at least one piston cylinder is disabled, selectively varying turbulence in an air intake pathway of an enabled piston cylinder, so as to vary charge motion within the enabled piston cylinder, where such selective variation of turbulence is effected at a location in the air intake pathway between a throttle of the engine and an intake valve of the enabled cylinder.

19. The method of claim 18, where said selective variation is performed by moving a turbulence member disposed at the location in the air intake pathway.

20. The method of claim 19, where the turbulence member is a charge motion control valve.

21. The method of claim 18, where turbulence in the air intake pathway is reduced to a minimum level upon detection of a noise, vibration, harshness (NVH) condition.

22. The method of claim 18, where turbulence in the air intake pathway is reduced to a minimum level in response to engine speed being below an engine speed threshold.

23. The method of claim 18, where turbulence in the air intake pathway is reduced to a minimum level in response to indicated torque for enabled piston cylinders being above a torque threshold.

24. The method of claim 18, where turbulence in the air intake pathway is reduced to a minimum level in response to engine speed being below an engine speed threshold, and indicated torque for enabled piston cylinders being above a torque threshold.

25. A method of operating an internal combustion engine, comprising:

disabling and enabling a first piston cylinder of the engine;

positioning a turbulence member in a first position while the first piston cylinder is disabled, the turbulence member being movably disposed in an air intake pathway between a throttle of the engine and an intake valve of an enabled piston cylinder; and positioning the turbulence member in a second position while the first piston cylinder is enabled, where moving the turbulence member from the first position to the second position causes turbulence to vary in the air intake pathway.

* * * * *